US005733164A

United States Patent [19]

Albrecht

[11] Patent Number: 5,733,164

[45] Date of Patent: Mar. 31, 1998

[54] GLIDER WITH LAUNCHING SYSTEM

[76] Inventor: Glenn C. Albrecht, P.O. 159, Wittman, Md. 21676

[21] Appl. No.: 622,470

[22] Filed: Mar. 25, 1996

[51] Int. Cl.[6] ..... A63H 27/14; A63H 27/00

[52] U.S. Cl. ..... 446/63; 446/67; 446/68

[58] Field of Search ..... 446/34, 61, 62, 446/63, 64, 65, 66, 67, 68, 69, 129, 429, 488

[56] References Cited

U.S. PATENT DOCUMENTS

| | | | |
|---|---|---|---|
| 1,599,280 | 9/1926 | Lewis . | |
| 2,251,090 | 7/1941 | West | 446/68 X |
| 2,708,330 | 5/1955 | Ciampolini . | |
| 3,187,460 | 6/1965 | Robertson . | |
| 3,264,777 | 8/1966 | McCreary, Jr. . | |
| 3,408,767 | 11/1968 | Anderson . | |
| 3,654,729 | 4/1972 | Imperato . | |
| 3,898,765 | 8/1975 | Lee . | |
| 4,172,337 | 10/1979 | English | 446/67 |
| 4,308,849 | 1/1982 | Seregely | 446/63 X |
| 4,357,777 | 11/1982 | Kulik . | |
| 4,382,245 | 5/1983 | Harrigan | 446/129 X |
| 4,507,096 | 3/1985 | Greenfield, Jr. | 446/61 X |
| 4,698,041 | 10/1987 | Dasa | 446/61 |
| 4,842,222 | 6/1989 | Baird | 446/63 X |
| 4,997,401 | 3/1991 | Rose et al. | 446/64 |

FOREIGN PATENT DOCUMENTS

| | | | |
|---|---|---|---|
| 487347 | 10/1952 | Canada | 446/67 |
| 1028698 | 5/1953 | France | 446/62 |
| 614580 | 6/1935 | Germany | 446/68 |

*Primary Examiner*—D. Neal Muir
*Attorney, Agent, or Firm*—Nixon & Vanderhye P.C.

[57] ABSTRACT

The subject invention relates to a launcher and one or more gliders for use therewith. The dihedral of the glider is achieved with two parallel creases that run front to back down the center of the glider. At the leading edge of the wing surfaces, self adhesive strips of flat magnetic sheet stock can be applied to the top and bottom of each wing to provide both proper weight to initiate desirable trim to the glider and to provide a force to separate the nested planes after launching, i.e., magnetic repulsion. For a multiple launch, the gliders are stacked on top of one another and placed upside down and mounted on a launching stick. Through use of a vertical upward force the gliders are launched with sufficient force so that wind resistance will induce the glider wings to collapse upon themselves, facilitating a higher launch. At the peak of the launch, the combination of magnetic repulsion and the spring back of the glider wings to their designed high glide ratio configuration, permits each glider to successfully separate and glide to earth.

17 Claims, 5 Drawing Sheets

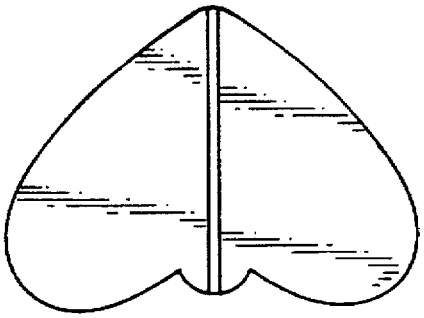
FIG. 3A
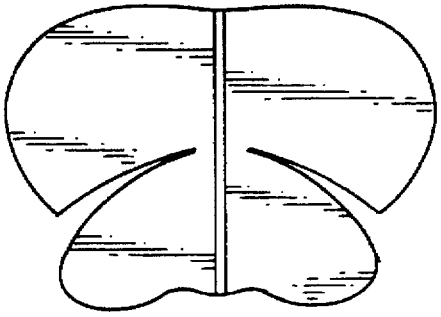
FIG. 3B
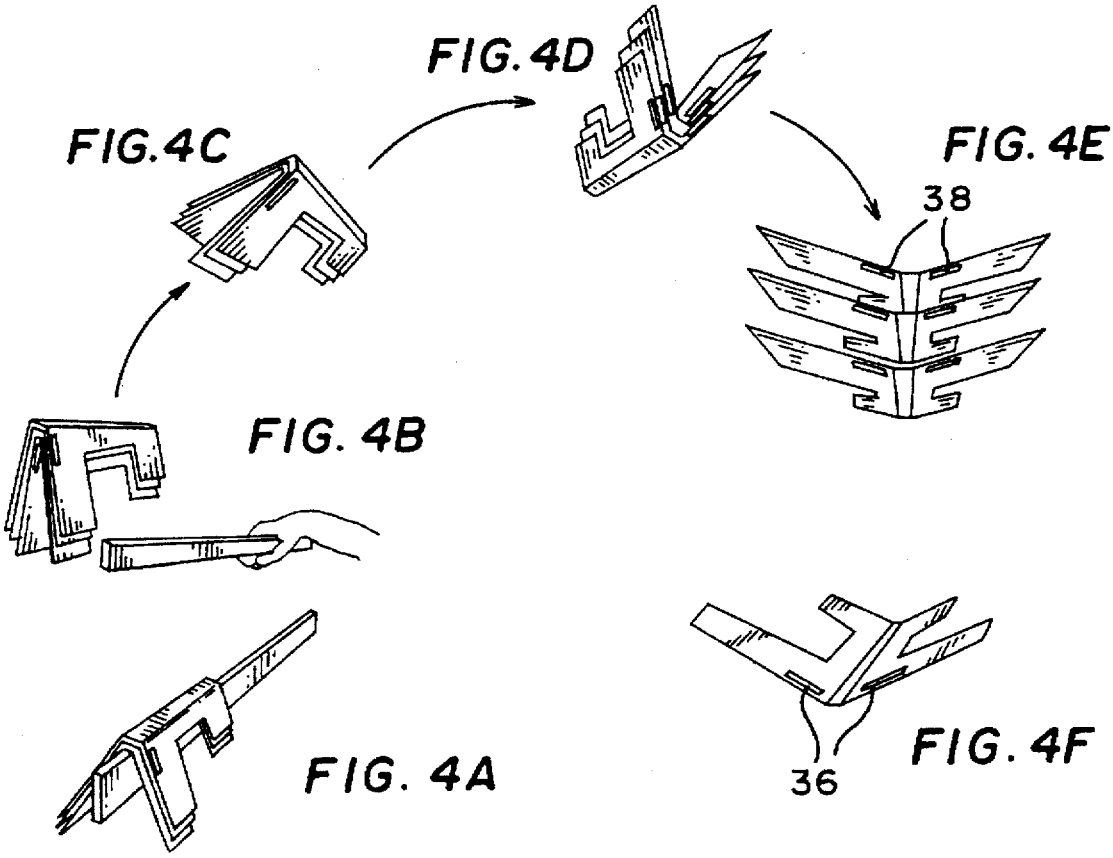

FIG. 7A
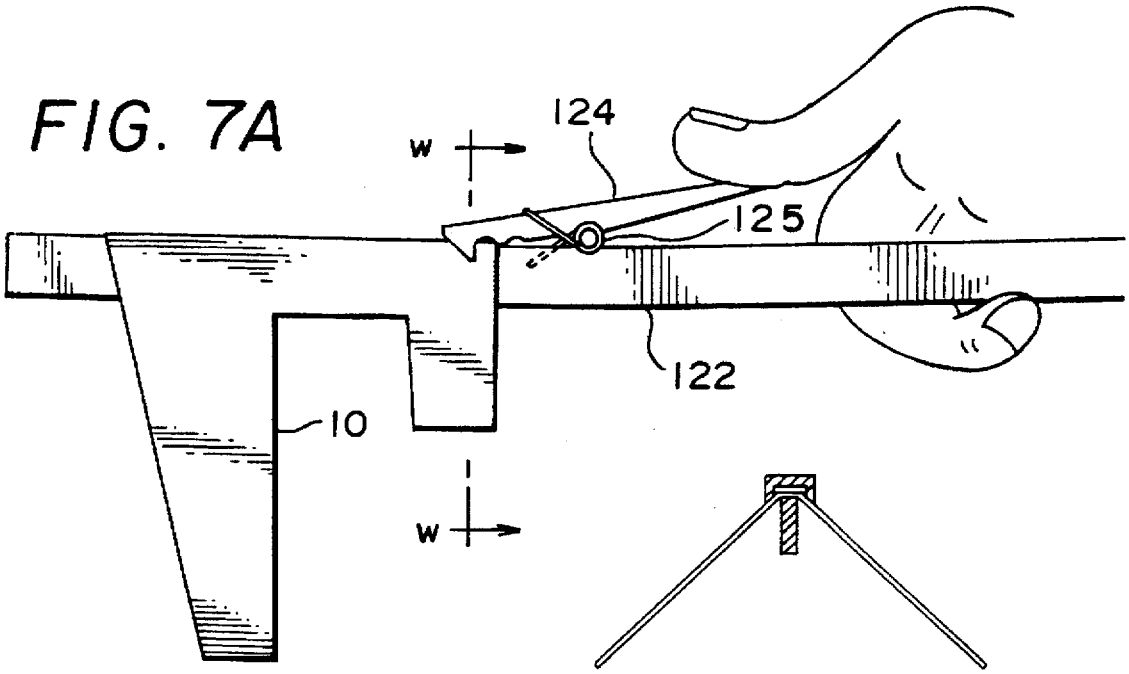
FIG. 7B
FIG. 8A
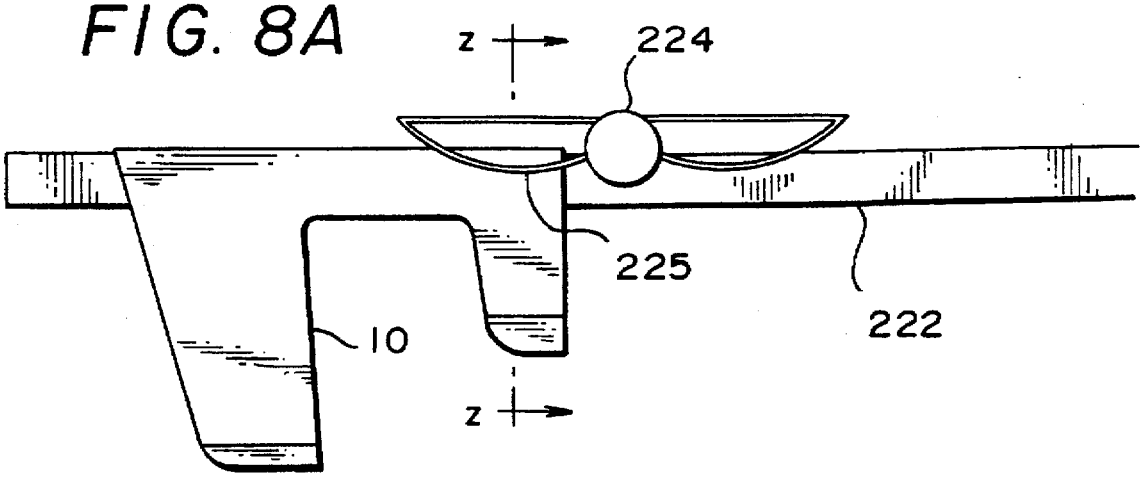
FIG. 8B
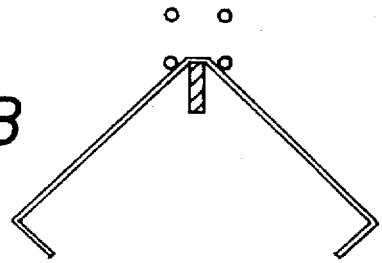

GLIDER WITH LAUNCHING SYSTEM

BACKGROUND OF THE INVENTION

1. Field of the Invention

The present invention relates to a launcher which facilitates the launching of one or more uniquely designed gliders. The invention permits a group of gliders to obtain great height prior to the group separating and descending individually. The multiplicity of gliders in simultaneous flight creates a unique elation amongst users and provides an activity for a group of users, be they children or adults.

2. Description of Prior Art

The following U.S. patents disclose various types of gliders and/or launchers:

U.S. Pat. No. 4,357,777 discloses a variable dihedral design for an aerodyne.

U.S. Pat. No. 2,708,330 discloses a glider toy that can be placed one upon another.

U.S. Pat. No. 1,599,280 discloses a folded, self opening airplane toy.

U.S. Pat. No. 3,408,767 discloses a swept wing with a catapult style launcher designed for single craft launch.

U.S. Pat. No. 3,654,729 discloses a swept back wing design with an articulating pivot point at the wing juncture.

U.S. Pat. No. 3,187,460 discloses one folding wing that facilitates a tumbling type launch to an apex and the one wing deploys to facilitate flight.

U.S. Pat. No. 3,898,765 discloses a foam glider with a tubular cavity that runs the length of the fuselage to permit the insertion of a rod type launcher, intended to be actuated with the user's arm.

U.S. Pat. No. 3,264,777 discloses a single plane launched from a stick/rod.

It is also known in the prior art that one or more simple paper airplane(s) can be launched from a hand held stick.

SUMMARY OF THE PRESENT INVENTION

The subject invention relates to a glider-launching stick combination wherein said glider comprises: a center section having a first longitudinal side and a second longitudinal side, a first wing extending outwardly and downwardly from said first side, a second wing extending outwardly and downwardly from said second side whereby said center section and said wings form an inverted V;

and wherein said launching stick comprises (a) a glider support section having a top surface, a pair of side surfaces, and a bottom surface and (b) a hand grip section; said top surface having a width approximently the width of said center section and adapted to slidably support the center section thereon with said first and second wings angularly disposed with respect to said pair of side surfaces; and (c) a holder means intermediate the length of said launching stick restraining any slidable movement between said glider and the said launching stick but insufficient to restrain movement when a user propels said launching stick with sufficient force to launch said glider, wherein during launch said wings move into a position of greater dihedral and at the apex of the launch said wings move into a position of predetermined high glide ratio.

The invention also relates to a glider comprising a center section having a first longitudinal side and a second longitudinal side, a first wing extending outwardly and angularly disposed with respect to said first side, a second wing extending outwardly and angularly disposed with respect to said second side whereby said center section and said wings form a V of predetermined high glide ratio.

In another embodiment the invention relates to a launching stick comprising (a) a glider support section having a top surface, a pair of side surfaces, and a bottom surface and (b) a hand grip section; and (c) a holder means intermediate the length of said launching stick capable of restraining any slidable movement between a glider and said launching stick but insufficient to restrain movement when a user propels said launching stick with sufficient force to launch said glider.

BRIEF DESCRIPTION OF THE DRAWINGS

FIG. 3A and 3B is a top elevation of other embodiments of the glider.

FIGS. 4 A through F are perspective views showing six stages of the launch and flight of the gliders.

FIG. 7A is a side elevation of another embodiment of holder means to hold the gliders to the stick. FIG. 7B is a crossection of FIG. 7A at W—W.

FIG. 8A is a side elevation of another embodiment of holder means to hold the gliders to the stick. FIG. 8B is a crossection of FIG. 8A at Z—Z.

DETAILED DESCRIPTION OF THE INVENTION

Figure 1:
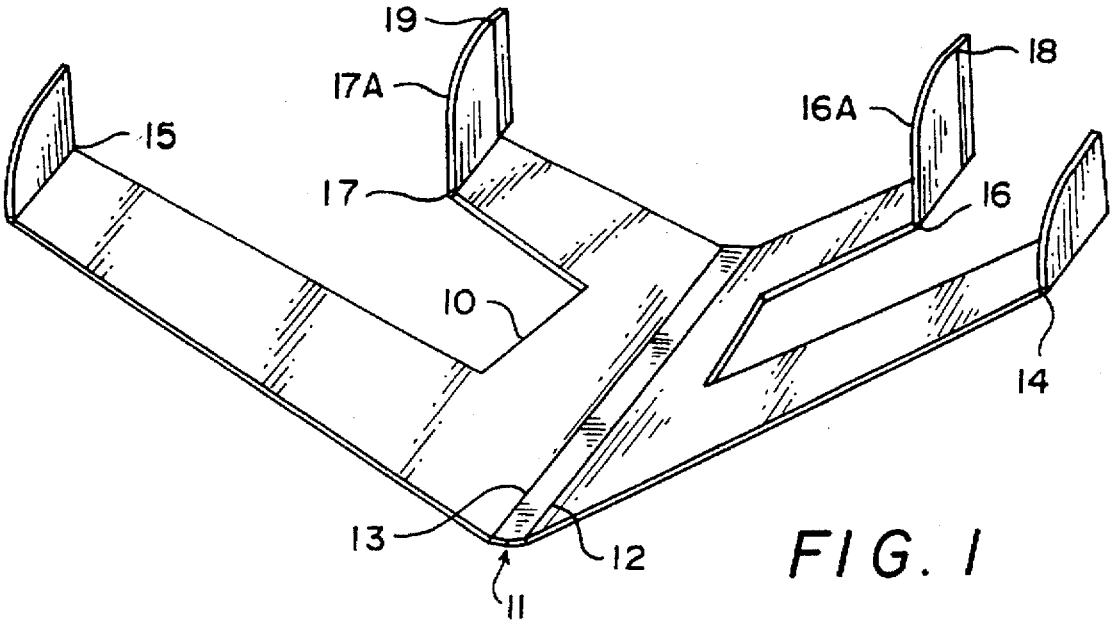
FIG. 1 is a perspective view of one embodiment of one glider of the invention.
Figure 2A:
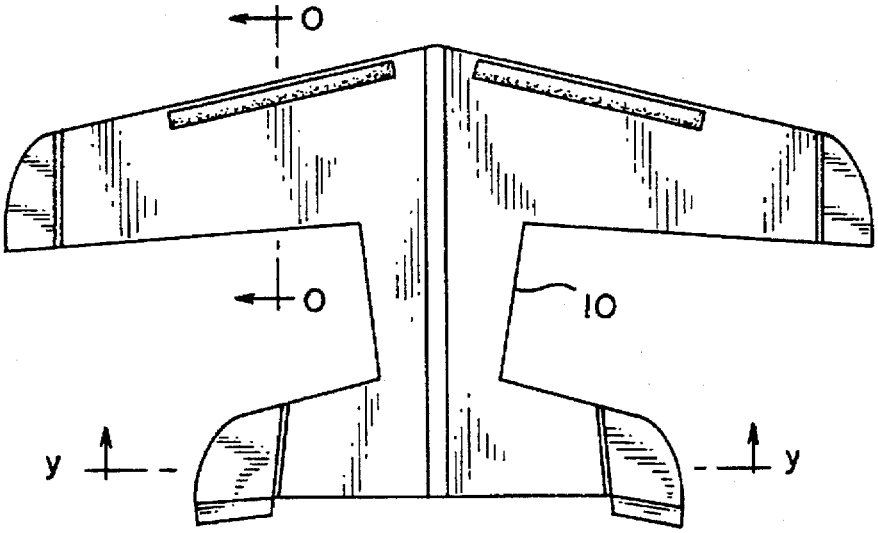
FIG. 2A is a top elevation of the glider of the invention prior to folding.
Figure 2B:
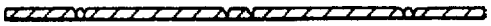
FIG. 2B is a crossection of 2A at Y—Y.

The present invention relates to a launcher-glider combination including an aerodynamically designed glider. The glider 10 in FIG. 1 has a longitudinal center section 11 defined by creases 12 and 13 that runs from the front center to rear center of the glider 10. FIG. 2 shows the die cut and scored sheet material from which the glider of FIG. 1 is made by folding along the creases. The center section 11 permits the glider wings to move downwardly while the glider is under upward pressure during launch. This hinge/wing arrangement increases dihedral and reduces aerodynamic drag during launch, yet when the glider is exposed to less pressure (at the peak of the launch), the memory characteristic of the glider material permits the glider to return to its predetermined high glide ratio shape 10 (less dihedral). In addition to creases 12 and 13, six optional creases at locations 14, 15, 16, 17, 18 and 19 are formed in the embodiment of the glider shown in FIG. 1. In another embodiment of the invention the creases at 14,15,16, and 17 each comprises two closely spaced, eg 0.060 to 0.100 inches apart, parallel creases (FIG. 2). These additional creases help the vertical stabilizers stay perpendicular to the wings, and reduce material fatigue at the point of folding.

Creases at locations 18 and 19 form flexural control surfaces ie, rudders, on the trailing edges of vertical stabilizers 16A and 17A. The design permits the stacking of gliders (see FIG. 4, optional stabilizers not shown).

The glider of this invention can be constructed of extruded polystyrene, expanded polystyrene, paper or plastic sheet stock. The glider is typically die cut and scored from foam or paper flat stock thus facilitating ease of manufacture and compact packaging (FIG. 2A). The flat die cut and scored glider is then formed into its predetermined high glide ratio configuration by folding at the creases. When properly cut and folded on disclosed lines the glider has a stable flying design.

Figure 2C:
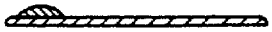
FIG. 2C is a crossection of 2A at O—O.

Gliders in FIG. 4 have weights located on each wing adjacent the leading edge. In a preferred embodiment, the gliders have magnetic strips on the top wing surfaces 36 and bottom wing surfaces 38 in close proximity to the wings leading edges. Optionally, magnetic strips can be placed on both sides of the center section adjacent the leading edge. When self adhesive single pole magnetic sheet stock strips (single pole is defined as outward facing surfaces being designated as North and inwardly facing ie, the side with adhesive coating which interfaces directly to the wing surface is designated South), are placed on both sides (top and bottom) of the wings as weights for proper glider trim; it has been discovered that due to the effects of magnetic repulsion, successful dispersal of launched groups is achieved. This improves the working dynamics and performance of gliders made in accordance with this invention. These self adhesive strips of single pole magnetic sheeting provide two significant functions: (1) they provide proper weight in the correct location for proper glider trim and (2) they aid the dispersal of the stacked gliders by use of repulsive forces generated by the face to face contact of like pole magnets. This repulsive force enables the separation of the gliders which in mm permits airflow to the underside of the wing surfaces thereby enabling proper flight dynamics. Optionally, strips of flexible, self adhesive magnetic sheets can be applied to the top wing surface and folded over and around the wing leading edge continuing to the underside of the wing surface. This option improves durability of the wings leading edge. Optionally the magnetic/weight material can be extruded in: (a) a C shaped profile that can be friction fit on to the leading edge of wings, (b) an airfoil shaped profile as in (a), or an airfoil shaped profile applied to the top surface of the wing adjacent the leading edge to improve aerodynamic properties of the wing (FIG. 2C).

FIG. 3A displays alternative glider shapes: bee/fly shape. FIG. 3B displays alternative glider shape:butterfly/moth shape.

The design of the launcher 20 (FIG. 4) permits launching of either a single glider or multiple stacked gliders. One preferred embodiment is a stick 22 with a holder 24 attached to effectively retain 1 to 5 gliders to the launcher 20 in a stable pre-launch position (the gliders are upside down and the dihedral increased slightly (to increase tension)while on the launcher). In an advantageous embodiment, the glider support section is angularly disposed with respect to the hand grip section (see FIG. 5). In a further advantageous embodiment, the top surface of the glider support section has a convex shape (FIG. 6). The holding action in this embodiment is a friction fit into a set of chocks (see FIG. 6) contained in holder 24.

FIG. 7 displays an embodiment wherein one or more gliders are held to stick 122 by a holding clamp 124. Holding clamp 124 exerts frictional force to the gliders via spring mechanism 125. Spring mechanism 125 also acts as a fulcrum permitting the holder to retain one or more gliders. FIG. 7B shows the point of interface between glider(s) and holding clamp 124 (note the dihedral of the wings is increased slightly when the glider is in the pre launch position).

In another embodiment of the holder (see FIG. 8) holder 224 from which projects loops 225 of either metal wire or plastic with a curved section at the bottom, to slideably receive 1 to 5 gliders. The wire or plastic loop 225 frictionally retains glider(s) to stick 222 (the dihedral of the wings is slightly increased from the predetermined high glide ratio, in the prelaunch position).

The glider 10 attached is launched by a flinging action of the user's arm hand and wrist (hand would be applied at location 26 of FIG. 5), such that the gliders are forced upward. The gliders can be launched at waist level with the user's palm facing downward, or above the shoulder with the user's palm facing upward.

Launcher 20 is typically constructed of injection molded plastic, injection molded ABS (acrylonitrile butadiene styrene), injected foam, wood, fiberglass or metal wire or rod.

The launching method is illustrated in FIG. 4 where a six step progression is shown. FIG. 4A shows three stacked gliders in pre launch position. FIG. 4B shows the three stacked gliders folded on themselves (increased dihedral) as a result of a sharp upward motion generated by the user with the launcher; this folding of the wings in conjunction with the mass of multiple gliders nested together enables the gliders to obtain great height prior to dispersal. FIG. 4C illustrates continued upward travel. FIG. 4D illustrates how, due to the memory of the flexible glider materials and the reduced air pressure at the apex of the glider's launch, the glider begins to return to the predetermined high glide ratio flying shape (less dihedral) shown in (FIG. 1). FIG. 4E shows three gliders in their normal flying shape after dispersal has occurred and individual flight paths have been established (note that after launch and typically after separation the gliders turn right side up). FIG. 4F shows one glider in descending flight.

Figure 5:
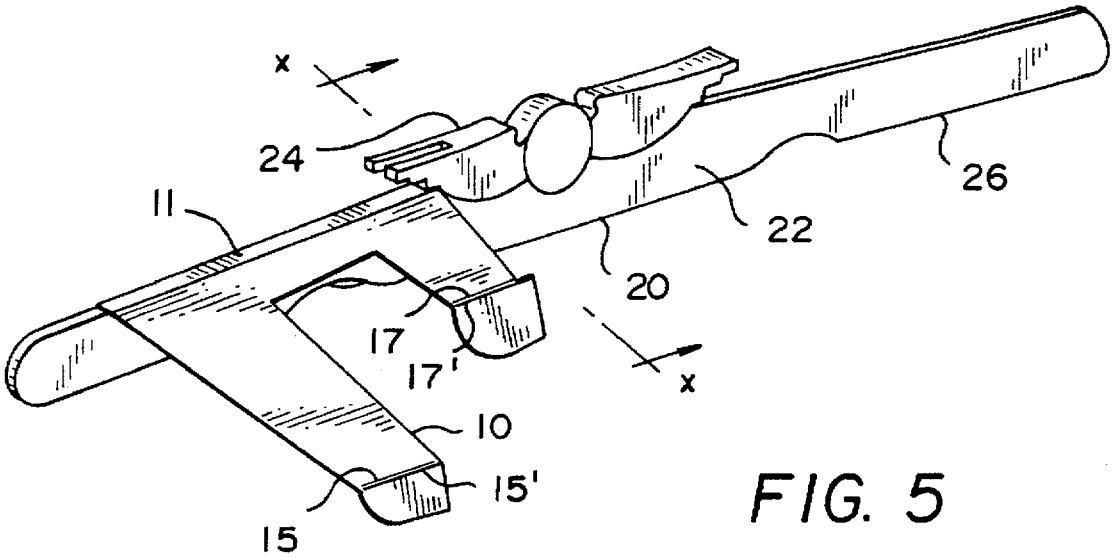
FIG. 5 is a perspective view of one glider in pre-launch position on the launcher.
Figure 6:
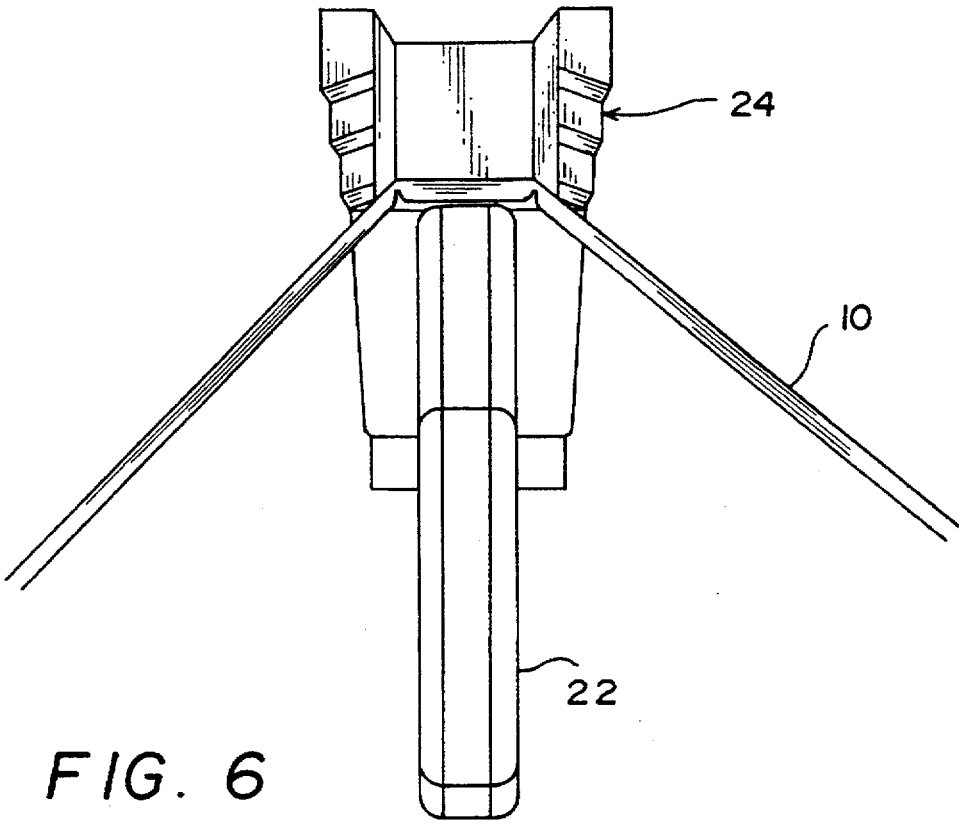
FIG. 6 is an end elevation of the embodiment of FIG. 5.

FIGS. 5 and 6 illustrates one embodiment of the interface between launching stick 22, glider 10 and holder 24 which holds single or multiple gliders (the holder 24 slightly increases the dihedral of the wings from the predetermined high glide ratio). The illustration shows one glider held by means of both friction and tension provided by the glider material that wants to return to its predetermined high glide ratio. This positive gripping is desirable for purposes of securely holding the gliders on windy days, or inverted in pre-launch position.

Figure 9:
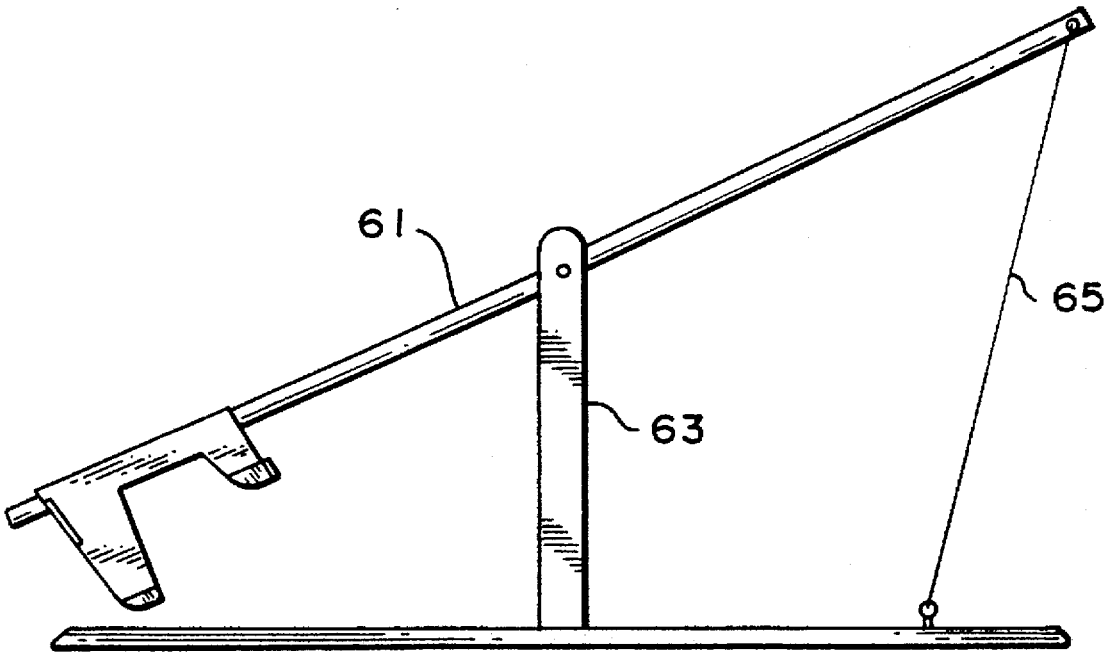
FIG. 9 is a side elevation of an alternative embodiment of the launcher.

FIG. 9 displays a further embodiment of the launcher which includes a spring tensioned catapult system. Stick 61 is set upon a fulcrum 63 to permit a launching movement actuated by release of a spring/elastic band 65.

What is claimed:

1. A glider and launching stick combination wherein said glider has a high glide ratio configuration and is formed of a material which remembers said configuration;

said glider comprising a center section;

a first wing extending outwardly and downwardly from said center section and a second wing extending outwardly and downwardly from said center section at an angle to said first wing so as to form an inverted V when said glider is supported on said launching stick;

a first weight affixed to said first wing and a second weight affixed to said second wing;

said launching stick comprising a glider support section having a top surface, first side surface, a second side surface, and a bottom surface;

a hand grip section;

a holder means intermediate the length of said launching stick for restraining any slidable movement between said glider and said launching stick but insufficient to restrain movement when the user swings said launching stick with sufficient force to launch said glider to cause said wings to move closer together because of air resistance and into a position of greater dihedral and at the apex of said launch said wings return to said high glide ratio configuration.

2. The combination of claim 1 wherein magnetic strips of the same magnetic polarity are respectively affixed to said first wing and to said second wing.

3. The combination of claim 1 wherein said first and second wings have leading edges and trailing edges and said magnetic strips are affixed to said wings adjacent said leading edges.

4. The combination of claim 1 wherein said glider has a pair of tail wings extending from said center section.

5. The combination of claim 1 wherein the ends of said wings have vertical stabilizers angularly disposed.

6. The combination of claim 5 wherein vertical stabilizers have leading edges and trailing edges and said trailing edges have angularly disposed rudders extending therefrom.

7. The combination of claim 1 wherein a space is defined between said holder means and said top surface having a depth to frictionally receive said trailing edges of said wings.

8. The combination of claim 7 wherein a plurality of spaces are formed between said holder and said top surface for receiving a plurality of said glider.

9. The combination of claim 1 wherein said glider is formed from extruded polystyrene.

10. The combination of claim 1 wherein said launching stick is formed from injection molded ABS plastic.

11. The combination of claim 1 wherein said holder means is a spring tensioned clamp.

12. The combination of claim 1 wherein said holder is a set of chocks.

13. The combination of claim 1 wherein said holder is pair of loops.

14. A glider having a high glide ratio configuration comprising a center section having a first longitudinal side and a second longitudinal side and having a forward end and a trailing end;

a first wing extending outwardly and angularly from said forward end of said first longitudinal side;

a second wing extending outwardly and angularly from said forward end of said second longitudinal side;

said center section and said wings forming a glider of predetermined high glide ratio;

a first weight affixed to said first wing and a second weight affixed to said second wing;

said first and second weights comprised of magnetic strips of the same magnetic polarity;

said first and second wings having leading edges and said magnetic strips respectively affixed to said wings adjacent said leading edges;

a third wing section extending outwardly from said trailing end of said first side and a fourth wing section extending outwardly from the trailing end of said second side; and control surfaces forming a part of said first, second, third, and fourth wing sections, said control surfaces enhancing said high glide ratio configuration.

15. A launching stick comprising a glider support section having a top surface, a pair of sides surfaces, and a bottom surface;

a hand grip section; and a holder means intermediate the length of said launching stick between said glider support section and said hand grip section;

said holder having a first surface spaced from said top surface a distance sufficient to frictionally receive a plurality of gliders therebetween for restraining slidable movement between said gliders and said launching stick but insufficient to restrain movement when a user swings said launching stick with sufficient force to launch said one or more gliders.

16. The launching stick of claim 15 wherein said holder consists of pivot means securing said holder means to said stick;

spring means to bias said first surface toward said top surface; and hand-operated lever means for opposing said bias by moving said first surface away from said top surface.

17. A plurality of gliders and a launching stick combination comprising a plurality of gliders, each of said gliders having a high glide ratio configuration and formed of a material that remembers said configuration and said gliders shaped for nesting one on top of another, forming a group of gliders, each of said gliders comprising a center section having a first longitudinal side and a second longitudinal side;

a first wing extending outwardly and downwardly from said first side; and said center sections and said wings forming a configuration having a high glide ratio;

said launching stick comprising a glider support section having a top surface, a pair of side surfaces, and a bottom surface; and a hand grip section;

said top surface adapted to slidably support said center sections of said group of gliders thereon, with said first and second wings of each of said gliders angularly disposed with respect to said first and second side surfaces; and a holder means intermediate the length of said launching stick restraining slidable movement between said group of gliders and said launching stick when said launching stick is at rest but insufficient to restrain movement when the user swings said launching stick with sufficient force to launch said glider;

wherein during said launch air resistance causes the wings of each of said gliders to move into a position of greater dihedral; and at the apex of said launch, in the absence of said air resistance, said wings return to said predetermined high glide ratio configuration; and said magnetic strips cause said gliders to separate from one another so that each glider follows an independent glide path.

* * * * *